US005649261A

United States Patent [19]

Schlickhoff et al.

[11] Patent Number: 5,649,261

[45] Date of Patent: Jul. 15, 1997

[54] APPARATUS FOR TREATING PHOTOGRAPHIC ORIGINALS WITH A TREATMENT LIQUID

[75] Inventors: Reiner Schlickhoff, Kamen, Germany; Giovanni Mento, Savona, Italy; Heinz-Guenter Moebius, Duisburg, Germany

[73] Assignee: Minnesota Mining and Manufacturing Company, St. Paul, Minn.

[21] Appl. No.: 505,355

[22] PCT Filed: Mar. 8, 1994

[86] PCT No.: PCT/EP94/00707

§ 371 Date: Nov. 13, 1995

§ 102(e) Date: Nov. 13, 1995

[87] PCT Pub. No.: WO94/20885

PCT Pub. Date: Sep. 15, 1994

[30] Foreign Application Priority Data

Mar. 10, 1993 [DE] Germany ..... 9303488 U

[51] Int. Cl.[6] ..... G03D 13/00

[52] U.S. Cl. ..... 396/571; 396/572; 396/626

[58] Field of Search ..... 354/299, 317, 354/319–324, 300; 165/110; 62/3.6, 3.4, 3.7, 458, 434, 452; 396/571, 572, 626, 627

[56] References Cited

U.S. PATENT DOCUMENTS 3,212,274 10/1965 Eidus ..... 165/110

3,230,723 1/1966 Korn ..... 62/3.6

4,350,429 9/1982 Slavin ..... 354/299

5,027,145 6/1991 Samuels ..... 354/299

5,059,996 10/1991 Bailey et al. ..... 354/317

*Primary Examiner*—D. Rutledge

*Attorney, Agent, or Firm*—William K. Weimer

[57] ABSTRACT

An apparatus (14) for developing an exposed proof (16) provided with a visible light absorbing composition such as color particles or pigments includes a transport means (22–28, 36) for transporting the proof (16) along a treatment liquid dispenser unit (30, 32) and a take-off device (44, 38, 40) for removing detached composition from the proof (16). A tempering device (48) is provided for keeping the treatment liquid, which in the dispenser unit (30, 32) is applied onto the proof (16), at the optimum temperature for the developing process. The tempering device (48) comprises at least one Peltier element (52) which has at least one of its two tempering faces thermally connected with treatment liquid. The Peltier element (52) is adapted to receive a reversible supply voltage whose amount and polarity can be controlled. Depending on the polarity of the supply voltage, the Peltier element (52) operates either as a heating element or a cooling element. Temperature control is performed by a temperature sensor (56) and a controlunit controlling the amount and the polarity of the supply voltage in dependence on the difference between the actual value and the desired value of the temperature.

29 Claims, 4 Drawing Sheets

28
28
28
46
98
98
III
III
28
28
28
94
96
66
68
96
96
94

IV 50
56
50
52
52
92
48
52
60
60
94
96
66
96
68
96
94

APPARATUS FOR TREATING PHOTOGRAPHIC ORIGINALS WITH A TREATMENT LIQUID

The invention is directed to an apparatus for treating photographic originals with a treatment liquid. Particularly, the invention is directed to an apparatus for developing an exposed proof provided with a visible light absorbing composition, particularly with color particles, the apparatus being of the type used, e.g., in the color proofing systems in the print industry. Particularly, in connection with the present invention, the term "photographic original" is meant to include photographic films and metal or plastic printing plates. In connection with the invention, the treating of such originals primarily comprises fixing and developing processes. Thus, the treatment liquid can particularly be a fixing and developing liquid.

Developer apparatus are normally provided with a transport means for transporting the proof to be developed through the apparatus and guiding it past various units. The first unit having the exposed proof guided therealong is a developer liquid dispenser unit which is mostly provided as a spray tube with an application roll. The developer liquid partially dissolves or disperses the color particle layer to detach color particles in those regions of the proof which previously have been exposed in the exposure device, as is the case in methods for positive printing. In methods for negative printing, the situation is exactly reverse thereto. The detached color particles are removed from the proof by a take-off device. Normally, this take-off device is provided as a rotating brush having the proof guided along it. In addition to the brush, water is supplied to the proof for washing off color particles. Excess water is wiped off by use of squeezing rolls or the like. Subsequently, the proof in dried in a drying means by preheated air prior to leaving the developer apparatus.

Known developer apparatus for color proofing systems are provided with a tempering device for tempering the developer liquid. For obtaining proofs of high quality, it is usually required that the developer liquid supplied to the developer liquid dispenser unit has a temperature within a predetermined range of temperatures (generally 23° C.–26° C.). For obtaining multi-colored proofs, the above described developing process is performed for each of the primary colors of the proof. Usually, multi-colored proofs are composed of the three colors a) red, blue and yellow or b) cyan, magenta, and yellow, and black in addition. Thus, the development of such a proof is carried out in four developing processes, which are interrupted by the laminating of the corresponding color particles and the exposure of the proofs provided with the color particles. This means that, when generating a multi-color proof, only phase-wise use is made of the developer apparatus each time. For the quality of the multi-colored proof, it is important that the developer liquid is kept at nearly an identical temperature during all development processes for a proof. In this regard, the absolute value of the temperature of the developer liquid is less important as long as the temperature is in the above defined range. Known developer apparatus are equipped with a temperature sensor or the like for detecting the temperature of the developer liquid. A control unit connected to the temperature sensor will then control the tempering device correspondingly for maintaining the developer liquid at a substantially constant temperature.

In known developer apparatus for color proofing systems, the heating of the developer liquid is performed by electrical heater elements or the like, whereas the cooling of the developer liquid is performed by heat exchanger systems using a cooling agent (water in most cases). Therefore, known developer apparatus need separate connections for supply or discharge of the cooling liquid. Thus, the location of known developer apparatus has to meet certain demands, i.e. a water supply conduit and a water discharge conduit must be available in the immediate vicinity for connection to the coolant circuit of the developer apparatus. This imposes heavy restrictions on known developer apparatus as to the range of applications and possible locations. A further disadvantage is the resultant considerable water consumption for cooling purposes during operation of the developer apparatus.

It is one aspect of the invention to provide an apparatus for treating photographic originals which, with respect to the tempering of the developer liquid, can be placed at any desired location.

The invention will be described and explained with reference to a developer apparatus for color proofing systems as an example for a treatment apparatus for treating photographic originals with a developer liquid.

According to a first variant of the invention, there is described an apparatus for treating a photographic original with a treatment liquid, particularly an apparatus for developing an exposed proof provided with a visible light absorbing composition such as a colorant, color particles or the like, wherein

- the tempering device comprises at least one Peltier element having two tempering faces,
- the Peltier element is connectable to a supply voltage which can be changed in polarity, wherein, depending on the polarity of the supply voltage, the first tempering face can be heated and the second tempering face can be cooled, or the first tempering face can be cooled and the second tempering face can be heated, and
- at least the first tempering face of the Peltier element can be thermally contacted with the developer (treatment) liquid to be supplied to the developer liquid (developer liquid) dispenser unit.

Thus, in the apparatus of the invention, there are used one or a plurality of Peltier elements for maintaining the developer liquid at a constant temperature which is best suited for the developing process. According to the initial temperature of the developer liquid, the developer liquid has to be heated or cooled to reach its optimum operating temperature. It is a special feature of the invention that both heating and cooling are performed by Peltier technology.

Peltier elements are well known in the state of the art (DE 33 40 667 A1, DE 40 36 210 A1, WO 89/05129, DE 41 09 677 A1, EP 0 338 283 A1). However, prior art publications lack any suggestion to perform tempering—i.e. to maintain a developer liquid or another developer liquid provided for treatment, particularly for developing or fixing photographic originals, at a constant temperature—by using one or a plurality of Peltier elements, with the peltier elements being selectively used for cooling or heating.

Peltier elements are primarily used for cooling (EP 0 338 283 A1). Using the hot side of a Peltier element to heat a functional medium (i.e. the developer liquid in the instant case) is a less widespread approach. It is particularly advantageous to use a Peltier element for the tempering of liquids or other media which have an initial temperature above or below their operating temperature and therefore can and must be cooled or heated, respectively. If these purposes are fulfilled by only one aggregate, i.e. the Peltier element—which, by reversing the polarity of the supply D.C. voltage, can be used both for cooling and for heating—the technical and constructional complexity of apparatus is considerably reduced.

Peltier elements make use of the so-called Peltier effect, a reversal of the Seebeck effect in thermocouple elements. Two materials having different Seebeck coefficients (normally, semiconductor materials are used), when subjected to a D.C. voltage (low voltage), will heat up or cool down at their connecting regions or cool down or heat up at their mutually averted ends. Thus, Peltier elements comprise materials arranged in pairs and having different Seebeck coefficients, said materials being arranged behind each other spatially and electrically. The respective regions connecting the materials of such a pair of materials, comprising materials having good thermal or electric conductivity, form one tempering face of a Peltier element, while the regions-connecting the materials of adjacent pairs of materials likewise have good thermal and electric conductivity and form the other tempering face of the Peltier element. According to the first variant of the invention explained here, there is used respectively at least one of these tempering faces for temperature control of the developer liquid, and this tempering face is either heated or cooled by changing the polarity of the supply voltage.

The developer apparatus for color proofing systems provided by the invention can be placed at any desired location since it is not dependant anymore on immobile connections for coolant circuits (supply and discharge of coolant—particularly water). Further, the Peltier technology, in terms of construction and manufacture, presents a simple and room-saving solution for a self-sufficient heat pump wherein, e.g., in contrast to heat pumps operating according to the compressor or absorber principle, no complex constructional elements (compressor motor, absorber, circulating pumps, decompressors) are required.

In the apparatus of the invention, tempering of the developer liquid is carried out with high accuracy since tempering need be performed only on that quantity of liquid which is used for the current developing process. Thus, it is not the whole quantity of developer liquid contained in a (supply) reservoir or the like, but always only the currently required quantity that is tempered, i.e heated or cooled as required, for keeping it on the operating temperature. Thus, the tempering apparatus has a low, energy demand and can be given a small size which in turn allows for a more compact overall structure of the developer apparatus. This advantage is further enhanced by the fact that the invention can do without any coolant cycle with connecting means on the developer apparatus for supply and discharge of the coolant. This will also save energy. The use of a Peltier element for heating purposes does not only allow compact dimensions of the heater device but offers the additional advantage that the "cold" which during heating is emanated from the cold side, causes a local cooling of the developer apparatus. Especially in case of a compact arrangement of the individual elements of the apparatus, this is favorable for the prevention of excessive heat build-up of the apparatus during operation. All of the above aspects together make it possible to provided a small-sized, compact and reliable developer apparatus for color proofing systems which represents a stand-alone solution. Therefore, color proofing systems provided with the inventive developer apparatus will be of use also in smaller graphic-reproduction and printing businesses.

According to a second variant of the invention, the developer apparatus includes—among other elements—a transport means for transporting the proof (the photographic original) along a transport path, a developer liquid (developer liquid) dispenser unit for supplying developer liquid (developer liquid) to the proof (the photographic original), and a tempering device for the developer liquid (developer liquid) to be supplied to the developer liquid dispenser unit through a conduit. In this variant of the invention, at least one Peltier element which is used for cooling the developer liquid. If required, a plurality of Peltier element can be used for cooling. Heating of the developer liquid is performed by a normal electric heating element. Preferably, at least two Peltier elements are used, one of them provided exclusively for the heating function and the other one provided exclusively for the cooling function. As a matter of course, it is also possible to use a plurality of Peltier elements for heating and a plurality of Peltier elements for cooling. In this case, it is not required to reverse the polarity of the supply D.C. voltages for the Peltier element(s) because either of the Peltier elements are activated without the need to change their function as a heating or cooling element. The constructional and functional advantages obtained by this variant (compactness of the apparatus with low energy consumption and low heat-up during normal operating conditions) are the same as those described in connection with the first variant.

Finally, instead of reversing the polarity of the supply D.C. voltage of a Peltier element, it is also possible to cause the to-be-tempered developer liquid to flow along the one or the other tempering face in dependence on its initial temperature and the desired temperature. Thus, in this variant of the developer apparatus, it is provided—among other features—that the tempering device comprises at least one Peltier element provided with a heatable and a coolable tempering face, that both tempering faces of the Peltier element can be contacted with developer liquid, and that the conduit for the developer liquid includes a deflecting means for selectively having the developer liquid—or at least part of it—flowing along the one or the other tempering face. In this variant of the invention, the conduit for the developer liquid includes a branch conduit such that the two bifurcated conduits are guided along both tempering faces of the Peltier element, i.e. along both sides thereof. The deflecting means directs the flow either along the one or along the other of the tempering faces; it is also possible to provide a deflection in such a manner that two partial flows are generated.

In an advantageous embodiment of the invention according to the above first two variants, one tempering face of the Peltier element can be thermally contacted with the developer liquid to be tempered, while the other tempering face can be thermally contacted with a heat/cold discharge device. Depending on the operation of the Peltier element, the heating of the developer liquid requires an accompanying discharge of cold from the second tempering face which is not contacted with the developer liquid, while the cooling of the developer liquid requires an accompanying discharge of heat from the tempering face which is not contacted with the developer liquid. This is suitably accomplished by the Peltier element having one of its surfaces abutting on a heat/cold discharge body. The discharge of thermal energy can be enhanced by exposing the heat/cold discharge body to the air stream of a blower.

For avoiding that the respective tempering face of the Peltier element used for tempering the developer liquid is wetted by developer liquid, a heat/cold transmission member (in its most simple version provided as a plate having good thermal conductivity) is suitably arranged between the Peltier element and the developer liquid. This heat/cold transmission member is in thermal contact with the respective tempering face of the Peltier element. Preferably, the heat/cold transmission member forms part of the inner surface of the conduit through which the developer liquid flows to the developer liquid dispenser unit.

Preferably, the conduit for the developer liquid in the region of the heat/cold transmission member has an S-shaped configuration or comprises a plurality of parallel channels for forming a comparatively long conduit path along which the developer liquid is in thermal contact with the heat/cold transmission member.

For forming a closed control loop, there is provided, according to a preferred embodiment of the invention, a temperature sensor for measuring the actual temperature of the developer liquid downstream of the Peltier element(s) when viewed in flow direction. Additionally, the initial temperature, i.e. the temperature of the developer liquid upstream of the tempering device, can be measured by an additional temperature sensor which is arranged upstream of the tempering device. According to the output signal(s) of the temperature sensor(s), a control unit controls the voltage generating device for the Peltier elements in such a manner that those respective tempering faces of the Peltier element (s) which are used for tempering purposes, are brought to the temperature required for reaching the desired temperature. In the above described first variant, the control unit determines not only the amount but also the polarity of the supply voltage for the Peltier element. In the above described second variant, there is driven either the Peltier element provided for heating or the Peltier element provided for cooling in dependence on the actual temperature value of the developer liquid and its deviation from the desired value.

For improving the effectiveness of a Peltier element, it is further desired that the dissipation of thermal energy (heat or cold) from that face which is not in thermal contact with the developer liquid is performed as fast as possible. For this reason, it is advantageous to arrange the Peltier element in that region of a heat/cold dissipation body in which the temperature profile of the heat/cold dissipation body has an extreme value. If a plurality of Peltier elements are used, the first Peltier element in flow direction should be located in the above defined region of the dissipation body. Thus, for instance, in the case of an heat/cold dissipation body having an elongate profile, the first Peltier element in the flow direction is to be located in the middle of the longitudinal dimension of the dissipation body; if, e.g., two additional Peltier elements are used, these should be arranged substantially in the center of the two halves of the dissipation body.

Preferably, the thermal energy which, through energy. loss, is dissipated by the tempering device and particularly by the heat/cold dissipation device, is to be returned into the developing process. One possibility consists in using this thermal energy for drying the proof. Namely, developer apparatus of the type discussed here are provided with a wishing unit in which water is sprayed onto the exposed proof for washing off partially solved color particles and developer liquid. The proof wetted with developer liquid and water must be dried before leaving the apparatus. This is suitably accomplished in the transport path of the proof within the developer apparatus by guiding the proof transversely through a channel having hot air flowing therethrough. This hot air flow may be generated by at least one blower. The air removed by the blower preferably passes along the heat/cold dissipation device (heat/cold dissipation body) or along other units of the tempering device which dissipate thermal energy through energy loss. This is advantageous especially during the cooling phases of the tempering device because the Peltier element will then transmit heat to the heat/cold dissipation body. If the heat/cold dissipation device itself is provided with blowers, the air flow generated by these blowers is suitably guided directly to the intake side of the blowers of the drying means.

Basically, the above described embodiment can be contemplated regardless of what specific type of unit is chosen for tempering the developer liquid. Preferably, however, the above described recycling of thermal loss energy of the tempering device is used in connection with Peltier elements for tempering the developer liquid.

As to the configuration of the tempering device in which the developer liquid is heated and/or cooled, many different embodiments are possible. All of these embodiments require that the developer liquid flows along surfaces and/or flows through elements consisting of a material of good thermal conductivity. Thus, for instance, it can be provided that the developer liquid flows through a flat block of thermally conductive material having passage bores formed therein. Large side faces on this flat block may have the Peltier elements arranged thereon. The number of the Peltier elements mounted on the block depends on the demands posed on the tempering of the developer liquid, and on the flow quantities of developer liquid per time unit. Under all these marginal conditions defined by the technology of the developer apparatus itself, it must always be safeguarded that the supplied developer liquid has a substantially constant, uniform temperature within the optimum range of temperatures.

An embodiment of the invention will be described hereunder in greater detail with reference to the drawings.

Figure 1:
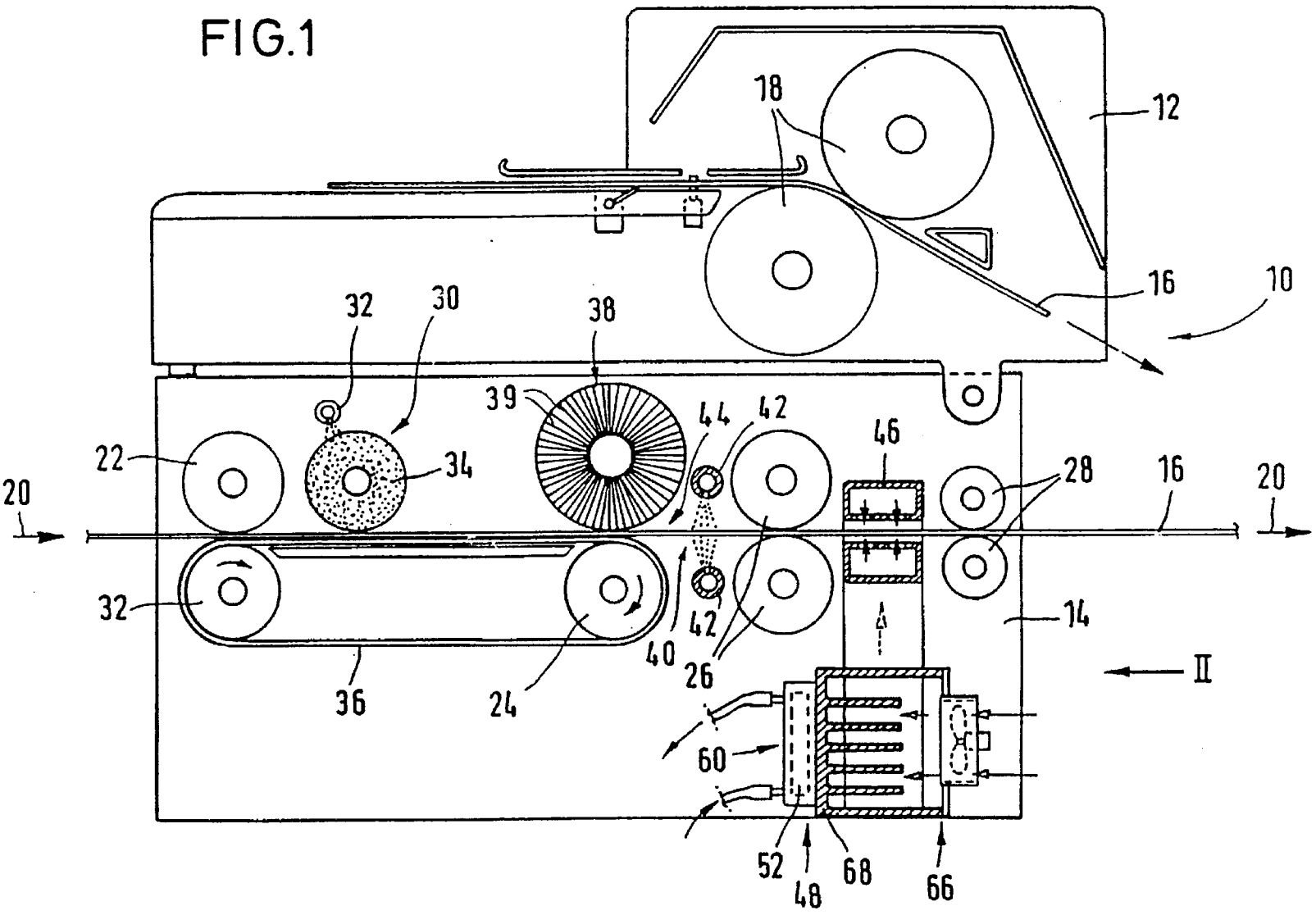
FIG. 1 is a side view of the basic internal construction of a combined unit consisting of a laminator unit and a developer unit for color proofing systems.

FIG. 1 is a schematic view of the internal construction of a combined apparatus 10 for color proofing systems. Apparatus 10 comprises a laminator unit 12 and a developer unit 14. In the laminator unit 12, a sheet (not shown) provided with color particles (not shown) is laminated onto a proof 16. For this purpose, the proof 16 is moved through laminator unit 12 by means of two pressure rollers 18. After proof 16 has left laminator unit 12, the carrier sheet (not shown) is withdrawn so that a layer of color particles (not shown) will remain on the proof. The thus treated proof is then exposed in an exposure station (not shown) and subsequently is developed in a developer unit 14.

A transport means is provided for transporting the proof 16 through developer unit 14 along the transport path indicated by the arrows 20. Said transport means may comprise a plurality of pairs of driven transport rollers 22,24,26,28 by which the proof 16 is moved. When viewed in transport direction (cf. arrows 20 in FIG. 1), the pair of intake rollers 22 has a developer liquid dispenser unit 30 arranged therebehind, comprising a spray tube 32 adapted for discharging developer liquid through its wall. Spray tube 32 is arranged above a foam roll 34 which is in contact with proof 16 and, during rotation, applies the developer liquid issuing from spray tube 32 onto proof 16. The transport rollers 24 are arranged behind the dispenser unit 30. Further, the transport means includes an endless transport belt 36 which is guided around the roller of the pair of rollers 22 and the transport roller 24 arranged below the transport path or the proof 16, respectively. The upper strand of transport belt 36 is moved in transport direction (see arrow 20).

Behind the transport rollers 24, there is arranged a rotating brush roller 38 with its bristles 39 sweeping along on the proof. Brush roller 38 serves for detachment and removal of color particles which have been partially dissolved by the developer liquid. In addition to brush roller 38, a washing device 40 is provided for removal of the partially dissolved color particles. Washing device 40 comprises two spray tubes 42 arranged on both sides of proof 16. By the water discharged from spray tubes 42, the detached color particles are washed off proof 14 along with the developer liquid. Brush roller 38 and washing device 40 together form the take-off device 44 for removal of color particles from proof 16.

Behind the spray tubes 42, the transport rollers 26 are arranged. which, in addition to their transport function, also act as squeezing rollers for wiping proof 16 clean of excess water and excess developer liquid along with the detached color particles. Transport rollers 26 are made from a relatively compressible material (rubber sponge and the like) so as to be able to displace water, developer liquid and color particles.

After moving through transport rollers 26, proof 16 travels through a drying air shaft or channel 46, passing through said channel 46 transversely to the longitudinal dimension thereof. Within channel 46, the portion of proof 16 located therein is subjected to a hot air flow on both sides of proof 16 so that the proof is dried. Behind the drying air channel 46, the take-off rollers 28 of the transport means are arranged for completely discharging the proof 16 from developer unit 14.

All of the above mentioned components and units extend through developer unit 14 transversely to the transport direction of proof 16.

FIG. 1 further shows a tempering device 48 for heating and/or cooling the developer liquid supplied to spray tube 32. Tempering device 48 is arranged in the supply conduit 50 through which the developer liquid is conveyed from a reservoir (not shown) to spray tube 32. Supply conduit 50 further includes a conveyor pump (not shown).

Figure 8:
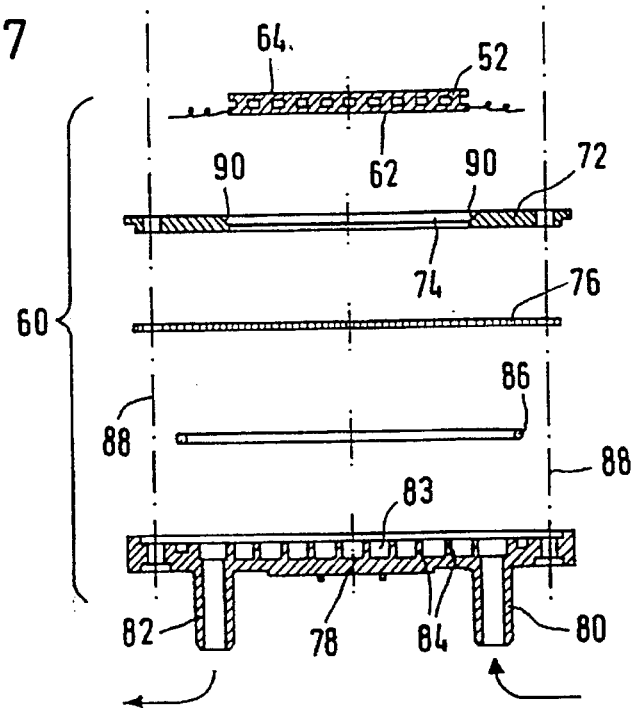
FIG. 8 is a block diagram of the electrical circuitry of the tempering device.
Figure 8:
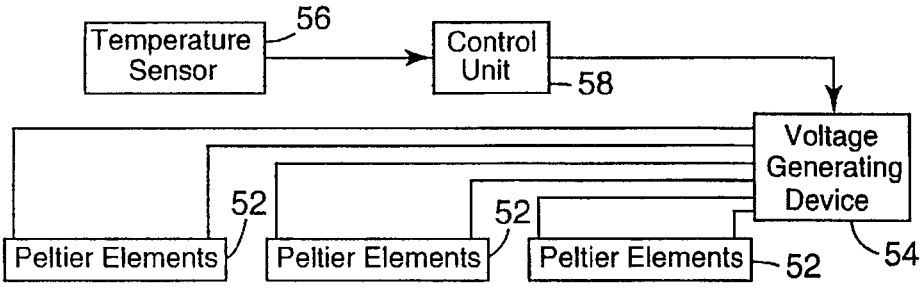

Tempering device 48 comprises three Peltier elements 52 which, when viewed in the flow direction of the developer liquid, are connected in series. Depending on the operating condition, the Peltier elements 52 either transmit heat to the developer liquid or withdraw heat therefrom for cooling purposes. According to FIG. 8, the Peltier elements 52 are electrically connected to a voltage generating device 54 of which the output D.C. voltage can be adjusted in voltage and polarity. In that part of conduit 50 which leads from tempering device 48 to spray tube 32, a temperature sensor 56 is arranged for measuring the temperature of the developer liquid to be supplied to spray tube 32. Temperature sensor 56 is electrically connected to a control unit 58 which compares the actual temperature delivered by temperature sensor 56 and the desired temperature, and which, according to the result of this comparison, emits control signals to voltage generating device 54 to control the amount and polarity of the supply voltage for the Peltier elements 52.

The advantage of the described connection of Peltier elements for tempering the developer liquid consists in that one and the same element can be used both for heating and cooling, i.e. for tempering or, respectively, for controlling the temperature of the developer liquid. By simply switching the polarity of the supply voltage for the Peltier elements 52, it becomes possible to switch their operating modes as cooling or heating elements. Further, by variation of the amount of the supply voltages for the Peltier elements, the temperature of the developer liquid can be controlled quite accurately within relatively narrow limits of ±0.5° C. Thus, use of the tempering device 48 meets the demands for generating proofs of high quality, i.e. obtaining a temperature of the developer liquid in the range between about 23° and 26° C., for example, and keeping that temperature constant over a long period of time.

Figure 5:
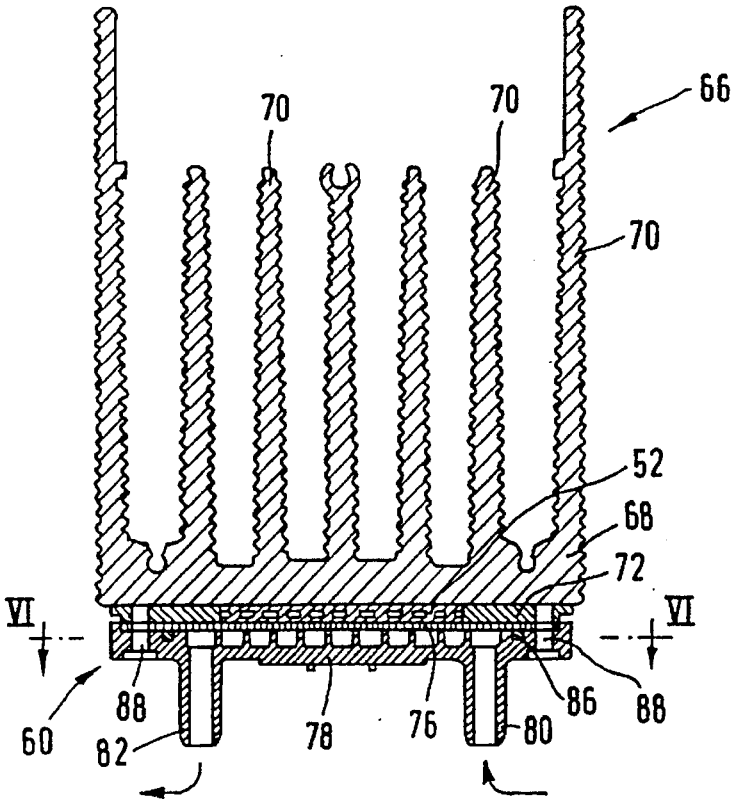
FIG. 5 is a sectional view along the plane V—V of FIG. 4.
Figure 6:
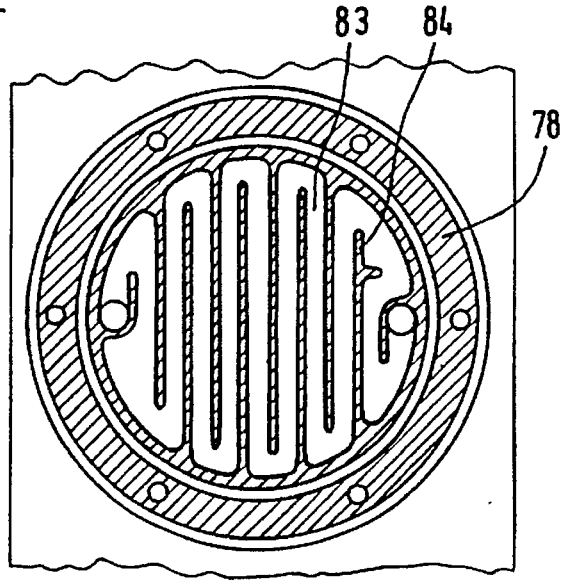
FIG. 6 is a sectional view along the plane VI—VI of FIG. 5.
Figure 7:
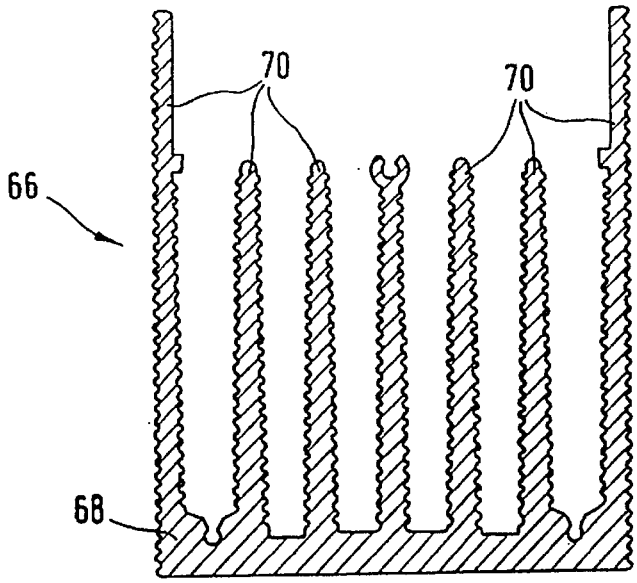
FIG. 7 is an exploded view of the arrangement shown in FIG. 5.

Each Peltier element 52 is coupled, through a special heat exchanger 60, to the conduit 50 conveying the developer liquid. The details of such a heat exchanger unit 60 are illustrated in FIGS. 5–7 and will be explained hereunder. The Peltier element 52 is provided as a plate-shaped element, with its two large-surfaced sides forming the tempering faces 62,64. Depending on the respective polarity of the applied supply voltage, one of the tempering faces will cool down while the other one will heat up, and vice versa. For improved dissipation of the heat or cold from that tempering face which is not thermally contacted with the developer liquid (in the instant embodiment, this is the tempering face 64 of FIG. 7), the Peltier element 52 has this tempering face 64 abutting on a heat/cold dissipation device 66.

Dissipation device 66 is provided with a heat/cold dissipation body 68 which, for enlarging its surface area, comprises a plurality of (cooling) ribs. For enhanced thermal contacting, a heat-conductive paste (not shown) is applied between the tempering face 64 facing towards the heat/cold dissipation body 68 and the heat/cold dissipation body 68. This paste-like heat transmitting medium consists of a heat-resistant grease (e.g. silicone) to which has been added a powder of heat-conductive metals (e.g., Be, Cu). Heat-conductive paste of this type is generally available in specialized trade in the field of electronics.

Peltier element 52 has its smaller sides enclosed by a plastic intermediate member 72 having an opening 74 corresponding to the geometrical shape of Peltier element 52. The thickness of intermediate member 72 is identical with the thickness of Peltier element 52. On the side of intermediate member 72 facing away from the heat/cold dissipation body 68, there is arranged a heat/cold transmission member 76 provided as a metallic plate being in heat-conductive contact with tempering face 64 of Peltier element 52 and being in thermal contact therewith by a layer of a heat-conductive paste (not shown). The heat/cold transmission member 76 is that element which is contacted by the developer liquid to be tempered, in that the developer liquid is guided along the surface of heat/cold transmission member 76. The heat/cold transmission member 76 is in abutment with a conduit guide member 78 made from plastic, which on its outer side averted from the heat/cold transmission member 76 is provided with an inlet connector 80 and an outlet connector 82. The inner side of conduit guide member 78 is provided with an open-topped, zig-zag-shaped channel system which connects the connectors 80,82 to each other and which is formed by individual, mutually spaced and mutually parallel ribs 84. For sealing the channel system having the developer liquid flowing therethrough, an O-ring 86 is provided which is arranged in a circumferential groove on the inner side of conduit guide member 78 and is in sealing abutment with the heat/cold transmission member 76.

The conduit guide member 78, the heat/cold transmission member 76, the intermediate member 72 and the heat/cold dissipation body 68 are screw-connected to each other as shown at 88 in FIGS. 5 and 7. For reduction of possible heat flow from the Peltier element 52 into the intermediate member 72, the opening 74 of intermediate member 72 is formed with a beveled portion 90 along the surrounding edge of the opening. The minimum cross section of opening 74 is dimensioned such that the intermediate member 72 surrounds the Peltier element 52 at a close distance only. This measure is desirable to prevent a heat connection between the two tempering faces 62,64 caused by laterally protruding heat conductive paste; this is accomplished because the intermediate member 72—due to its opening 74 dimensioned in the above manner—acts like a barrier between the two layers of heat conductive paste. For precluding loss of thermal energy via intermediate member 72 in this arrangement, the above beveled portion 90 along the edge of opening 74 is provided. An annular space is formed in the region of beveled portion 90 between intermediate member 72 and Peltier element 52, preventing direct contact between intermediate member 72 and Peltier element 52.

Figure 3:
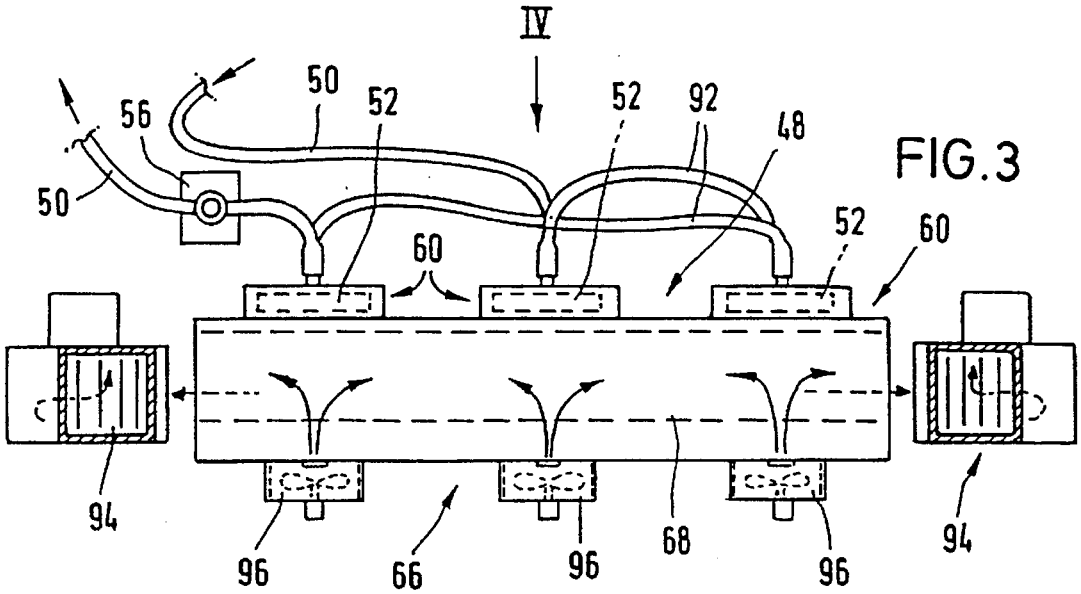
FIG. 3 is a plan view of the tempering device with a heat/cold dissipation device according to the plane III of FIG. 2.
Figure 4:
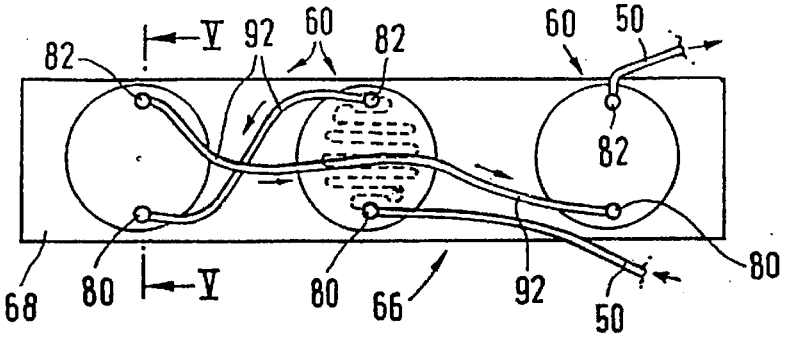
FIG. 4 is a view of the tempering device and the heat/cold dissipation device in the direction of arrow IV of FIG. 3.

As shown in FIGS. 3 and 4, all three heat exchanger units 60 are connected to the heat/cold dissipation body 68, while those tempering faces 64 which are not thermally contacted with the developer liquid are in thermally contacting abutment on heat/cold dissipation body 68. The three heat exchangers 60 are equally distributed over the length of heat/cold dissipation body 68, with the first heat exchanger 60 in the flow direction of the developer liquid being arranged in the center of heat/cold dissipation body 68. The two other heat exchangers 60 are arranged to both sides of the first heat exchanger 60. In FIG. 4, the liquid connection among the heat exchanger units 60 is illustrated by arrows drawn along the hoses 92 interconnecting the connectors 80,82 of the conduit guide members 78 and the heat exchanger units 60.

Figure 2:
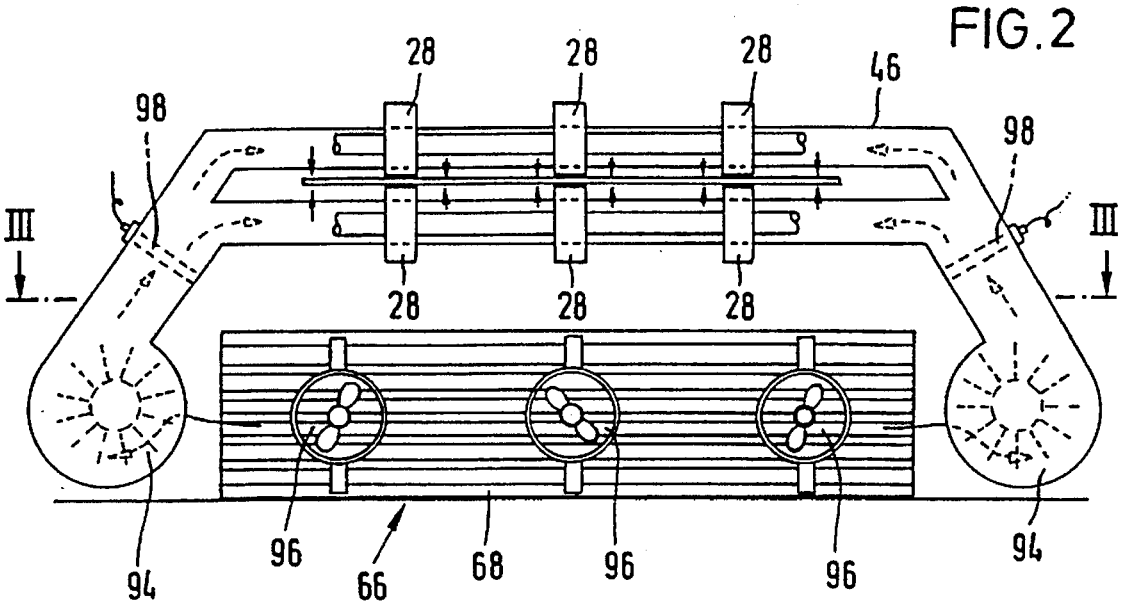
FIG. 2 is a rear view of the developer unit in the direction of arrow II of FIG. 1.

As evident from FIGS. 2 and 3, tangential blowers 94 are arranged in the immediate vicinity of the two axial ends of heat/cold dissipation body 68. Further, three blowers 96 are provided on the outer side of the heat/cold dissipation body 68 averted from the heat exchanger units 60. Said blowers 96 are arranged opposite the heat exchanger units 60 and generate air flows directed at right angles against heat/cold dissipation body 68 (see FIG. 3).

The blowers 96 improve the dissipation of thermal energy (heat or cold) via the heat/cold dissipation body 68. The air flow generated by the blowers 96 is guided to the intake side of the tangential blowers 94, which is performed, among other reasons, because of the construction of the heat/cold dissipation body 68 with its ribs 70 extending between the two tangential blowers 94. The tangential blowers 94 are connected to the ends of drying air channel 46 through which, as described above, the developed proof is horizontally passed before leaving the developer unit 14. Downstream of the tangential blowers 94, electrical heater units 98 (FIG. 2) are arranged for heating the air flow provided for drying. If the Peltier elements 52 operate as cooling elements for cooling the developer liquid, the tempering faces 62 of the Peltier elements 52 connected to heat/cold dissipation body 68 will give off heat which—by the air flows generated by blowers 96—is transmitted to the tangential blowers 94, which in this operating mode of the Peltier elements 52 improves the overall energy balance of the developer unit.

We claim:

1. An apparatus for treating a photographic original with a treatment liquid, particularly for developing an exposed proof provided with a visible light absorbing composition, in particular color particles, comprising a transport means (22–28,36) for transporting the original (proof 16) along a transport path (20), a treatment liquid dispenser unit (30,32) for applying treatment liquid to the original (proof 16), and a tempering device (48) for tempering the treatment liquid to be supplied to the treatment liquid dispenser unit (30,32) through a conduit (50), characterized in that the tempering device (48) comprises at least one Peltier element (52) provided with two tempering faces (62,64), that a supply voltage of reversible polarity can be applied to the Peltier element (52), wherein, in dependence on the polarity of the supply voltage, the first tempering face (62) can be heated and the second tempering face (64) can be cooled, or the first tempering face (62) can be cooled and the second tempering face (64) can be heated, and that at least the first tempering face (62) of the Peltier element (52) can be thermally contacted with the treatment liquid to be supplied to the treatment liquid dispenser unit (30,32).

2. The apparatus according to claim 1, characterized in that the Peltier element (52) can be thermally connected to the treatment liquid through the first tempering face (62) and that the second tempering face (64) can be thermally connected to a heat/cold dissipation device (66).

3. The apparatus according to claim 2, characterized in that the heat/cold dissipation device (66) comprises a heat/cold dissipation body (68) which is in heat-conductive contact with the second tempering face (64).

4. The apparatus according to claim 2, characterized in that the heat/cold dissipation device (66) comprises at least one blower (96) provided with a housing and serving for generating an air flow.

5. The apparatus according to claim 2, characterized in that the Peltier element (52) has at least the first tempering face (62) abutting on a heat-conductive heat/cold transmission member (76) having the treatment, liquid passing therealong.

6. The apparatus according to claim 5, characterized in that the heat-conductive heat/cold transmission member (76) comprises a surface separated from its abutment face with the first tempering face (62) of the Peltier element (52), said surface forming part of the inner surface of the conduit for the treatment liquid.

7. The apparatus according to claim 6, characterized in that the conduit for the treatment liquid in the region of the inner surface formed by the heat/cold transmission member (76) is provided as a plurality of channels or as one channel and has a labyrinthine pattern, particularly a zig-zag- or S-shaped pattern.

8. The apparatus according to claim 2, characterized in that the other tempering face abuts a heat/cold dissipation body (68).

9. The apparatus according to claim 5, characterized in that a heat-conductive mass is arranged respectively between the first tempering face (62) and the heat/cold transmission member (76), and between the second tempering face (64) and the heat/cold dissipation body (68), an intermediate member (72) having an opening (74) delimited by an opening edge is provided for the Peltier element (52), the Peltier element (52) is arranged within the opening (74), with the opening edge of the an intermediate member (72) surrounding the Peltier element (52) on all sides, and the opening edge is formed with a peripheral beveled portion (90).

10. The apparatus according to claim 1, characterized in that a) between the Peltier element (52) and a voltage generating device (54) for generating a supply voltage, a control unit (58) is connected for controlling the amount and the polarity of the supply voltage, and b) a temperature sensor (56) is provided for measuring the temperature of the treatment liquid to be supplied to the treatment liquid dispenser unit (30,32), said temperature sensor (56) being connected with the control unit (58) which in turn controls the supply voltage for the Peltier element (52) to maintain a presettable temperature of the treatment liquid.

11. The apparatus according to claim 1, characterized in that three Peltier elements (52) are provided, of which the first tempering faces (62), when viewed in the flow direction of the treatment liquid within the conduit, are arranged behind each other, and of which the second tempering faces (64) are respectively thermally connected to a heat/cold dissipation body (68), wherein the second tempering face (64) of the first Peltier element (52) in the flow direction of the treatment liquid can be connected to that region of the heat/cold dissipation body (68) in which an extreme value of the temperature profile of the heat/cold dissipation body (68) prevails resulting from the geometrical and physical conditions of the heat/cold dissipation body (68).

12. The apparatus according to claim 1, characterized in that a) the take-off device (44) for removal of said composition detached by the treatment liquid from the original (proof 16) comprises a washing device (40) for washing the original (proof 16), b) a drying means is provided for drying the washed original (proof 16) by an air flow, and c) that the drying means is adapted to receive the thermal energy taken off from that respective tempering face (62,64) of the at least one Peltier element (52) which cannot be thermally connected to the treatment liquid.

13. The apparatus according to claim 12, characterized in that said respective tempering face (62,64) of the at least one Peltier element (52) which cannot be thermally connected to the treatment liquid, is thermally connected to a heat/cold dissipation body (68), and that the thermal energy dissipated from the heat/cold dissipation body (68) can be supplied to the drying means.

14. The apparatus according to claim 13, characterized in that the drying means comprises at least one blower (94) which can be supplied with an air flow to be guided along the heat/cold dissipation body (68).

15. An apparatus for treating a photographic original with a treatment liquid, particularly for developing an exposed proof provided with a visible light absorbing composition, in particular color particles, comprising:

a transport means for transporting the original along a transport path;

a treatment liquid dispenser unit for applying the treatment liquid to the original;

a tempering device for tempering the treatment liquid to be supplied to the treatment liquid dispenser unit through a conduit, wherein the tempering device comprises at least one first Peltier element which is provided with a heatable first tempering and a coolable second tempering face and which is adapted to receive a supply voltage, wherein the coolable second tempering face of said at least one first Peltier element can be thermally connected with the treatment liquid; and at least one heater element for heating the treatment liquid to be supplied to the treatment liquid dispenser unit, wherein the at least one heater element comprises a second Peltier element provided with a heatable first tempering and a coolable second tempering face and adapted to receive a supply voltage, and wherein the heatable first tempering face of the first Peltier element and the coolable tempering face of the second Peltier element can each be thermally contacted with the treatment liquid.

16. The apparatus of claim 15, wherein the Peltier element can be thermally connected to the treatment liquid through its first tempering face, wherein the second Peltier element can be thermally connected to the treatment liquid through its second tempering face, and wherein the second tempering face of the first Peltier element and the second tempering face of the second Peltier element can each be thermally connected to a heat/cold dissipation device.

17. The apparatus of claim 16, wherein the heat/cold dissipation device comprises one or a plurality of heat/cold dissipation bodies being in thermal contact with the second tempering face of the first Peltier element and the second tempering face of the second Peltier element.

18. The apparatus of claim 16, wherein the heat/cold dissipation device comprises at least one blower provided with a housing and serving for generating an air flow.

19. The apparatus of claim 15, wherein the first Peltier element has its first tempering face and the second Peltier element has its second tempering face abutting on at least one heat/cold transmission member having the treatment liquid passing therealong.

20. The apparatus of claim 19, wherein the heat/cold transmission member comprises at least one surface separated from the abutment faces of the heat/cold transmission member with the first tempering face of the first Peltier element and with the second tempering face of the second Peltier element, wherein the surface forms part of the inner surface of the conduit for the treatment liquid.

21. The apparatus of claim 20, wherein the conduit for the treatment fluid in the region of the inner surface formed by the heat/cold transmission member is provided as a plurality of channels or as one channel and has a labyrinthine pattern.

22. The apparatus of claim 15, wherein the second tempering face of the first Peltier element and the first tempering face of the first Peltier element each abut a heat/cold dissipation body.

23. The apparatus of claim 15, wherein a heatconductive mass is arranged in each Peltier element between one tempering face and the heat/cold transmission member and between the other tempering face and the heat/cold dissipation body, wherein an intermediate member having an opening delimited by an opening edge is provided for the Peltier element, wherein the Peltier element is arranged within the opening with the opening edge of the intermediate member surrounding the Peltier element on all sides, and wherein the opening edge is formed with a peripheral beveled portion.

24. The apparatus of claim 15, wherein a control unit for controlling supply voltages is connected between the Peltier elements and a voltage generating device for generating their supply voltages.

25. An apparatus for treating a photographic original with a treatment liquid, particularly for developing an exposed proof provided with a visible light absorbing composition, in particular color particles, comprising a transport means (22–28,36) for transporting the original (proof 16) along a transport path (20), a treatment liquid dispenser unit (30,32) for applying treatment liquid to the original (proof 16), and a tempering device (48) for tempering the treatment liquid to be supplied to the treatment liquid dispenser unit (30,32) through a conduit (50), characterized in that a) the tempering device (48) comprises at least one Peltier element (52) provided with one heatable and one coolable tempering face (62,64), b) both tempering faces (62,64) of the Peltier element (52) can be connected to treatment liquid, and c) the conduit for the treatment liquid includes a deflecting means for selectively causing the treatment liquid—or at least part of it—to flow along one of the tempering faces and/or both tempering faces.

26. The apparatus according to claim 25, characterized in that a) between the Peltier element (52) and a voltage generating device (54) for generating its supply voltage, a control unit (58) is connected for controlling the supply voltage, and b) a temperature sensor (56) is provided for measuring the temperature of the treatment liquid to be supplied to the treatment liquid dispenser unit (30,32), and is connected with the control unit (58) which in turn controls the supply voltage for the Peltier element (52) to maintain a presettable temperature of the treatment liquid.

27. An apparatus for treating a photographic original with a treatment liquid, particularly for developing an exposed proof provided with a visible light absorbing composition, in particular color particles, comprising a transport means (22–28,36) for transporting the original (proof 16) along a transport path (20), a treatment liquid dispenser unit (30,32) for applying treatment liquid to the original (proof 16), a washing device (40) for washing treatment liquid off the original (proof 16), a tempering device (48) for tempering the treatment liquid to be supplied to the treatment liquid dispenser unit (30,32) through a conduit (50), said tempering device (48) dissipating thermal energy as loss energy, and a drying means for drying the washed original (proof 16) by an air flow, characterized in that the drying means is adapted to receive the thermal loss energy dissipated by the tempering device (48).

28. The apparatus according to claim 27, characterized in that the drying means comprises at least one blower (94) which can be supplied with an air flow to be guided along units of the tempering device (48) dissipating thermal loss energy.

29. The apparatus according to claim 28, characterized in that the blower (94) is a hot-air blower having a heater unit (98) arranged therebehind for heating the blown air.

* * * * *